US012129851B2

(12) United States Patent
Rolfes et al.

(10) Patent No.: US 12,129,851 B2
(45) Date of Patent: Oct. 29, 2024

(54) ECCENTRIC SCREW PUMP WITH WORKING ENGAGEMENT AND IDLE ENGAGEMENT AND METHOD FOR CONTROLLING THE ECCENTRIC SCREW PUMP

(71) Applicant: VOGELSANG GMBH & CO. KG, Essen (DE)

(72) Inventors: Michael Rolfes, Essen (DE); Paul Krampe, Essen (DE)

(73) Assignee: VOGELSANG GMBH & CO KG, Essen (DE)

( * ) Notice: Subject to any disclaimer, the term of this patent is extended or adjusted under 35 U.S.C. 154(b) by 0 days.

(21) Appl. No.: 18/071,801

(22) Filed: Nov. 30, 2022

(65) Prior Publication Data

US 2023/0167818 A1 Jun. 1, 2023

(30) Foreign Application Priority Data

Nov. 30, 2021 (DE) ..... 102021131427.5

(51) Int. Cl.
*F04C 2/107* (2006.01)
*F04C 14/06* (2006.01)
(Continued)

(52) U.S. Cl.
CPC ..... *F04C 2/1073* (2013.01); *F04C 14/06* (2013.01); *F04C 14/28* (2013.01);
(Continued)

(58) Field of Classification Search
CPC .... F04C 2/1071; F04C 2/1073; F04C 2/1075; F04C 14/00; F04C 14/06; F04C 14/28;
(Continued)

(56) References Cited

U.S. PATENT DOCUMENTS 2,085,115 A 6/1937 Moineau
2,527,673 A 10/1950 Cameron
(Continued)

FOREIGN PATENT DOCUMENTS

AT 223042 8/1962
AT 301297 8/1972
(Continued)

*Primary Examiner* — Theresa Trieu
(74) *Attorney, Agent, or Firm* — PRICE HENEVELD LLP

(57) ABSTRACT

An eccentric screw pump for delivering solid-laden liquids includes a rotor and a stator within which the rotor is rotatably arranged. The rotor and stator are arranged and designed with respect to one another in such a way that at least one chamber is formed, which serves to transport the liquid. The eccentric screw pump has a drive motor for rotating the rotor, a control device for controlling the drive motor at least in a working state, in which the rotor is rotated, and an idle state, in which the rotor does not rotate, and an engagement unit, which is designed to set an engagement between the rotor and stator to an idle engagement in the idle state and to a working engagement in the working state. The idle engagement is less than the working engagement. A method for operating the eccentric screw pump is also disclosed.

24 Claims, 12 Drawing Sheets

(51) Int. Cl.
*F04C 14/28* (2006.01)
*F04C 15/00* (2006.01)

(52) U.S. Cl.
CPC .... *F04C 15/0065* (2013.01); *F04C 2230/601* (2013.01); *F04C 2250/201* (2013.01)

(58) Field of Classification Search
CPC ..... F04C 15/0003; F04C 15/0015; F04C 15/0065; F04C 2230/00; F04C 2230/601; F04C 2230/602; F04C 2240/10; F04C 2240/20; F04C 2240/40; F04C 2240/811
See application file for complete search history.

(56) References Cited

U.S. PATENT DOCUMENTS

| | | | |
|---|---|---|---|
| 2,720,130 | A | 10/1955 | Chang |
| 3,139,035 | A | 6/1964 | O'Connor |
| 5,765,270 | A | 6/1998 | Schrod |
| 6,322,300 | B1 | 11/2001 | Santorius et al. |
| 6,358,027 | B1 | 3/2002 | Lane |
| 6,457,958 | B1 | 10/2002 | Dunn |
| 2009/0214369 | A1 | 8/2009 | Brun et al. |
| 2011/0305589 | A1 | 2/2011 | Raether |
| 2015/0322946 | A1 | 11/2015 | Krampe |
| 2015/0354280 | A1 | 12/2015 | Downton et al. |
| 2016/0195087 | A1 | 7/2016 | Downton |
| 2016/0208798 | A1 | 7/2016 | Sawyer et al. |
| 2016/0327037 | A1 | 11/2016 | Rothschild et al. |
| 2017/0074100 | A1 | 3/2017 | Jarvis et al. |
| 2017/0314551 | A1 | 11/2017 | Sakakihara et al. |
| 2018/0172041 | A1 | 6/2018 | Boyer et al. |
| 2020/0124046 | A1* | 4/2020 | Krampe ..... F04C 2/1071 |
| 2021/0301817 | A1 | 9/2021 | Hartogh et al. |

FOREIGN PATENT DOCUMENTS

| | | |
|---|---|---|
| AU | 2015202547 | 11/2015 |
| CN | 1421613 | 6/2003 |
| CN | 1570396 | 1/2005 |
| CN | 203035546 | 7/2013 |
| CN | 103883522 | 6/2014 |
| CN | 104047846 | 9/2014 |
| CN | 106640627 | 5/2017 |
| CN | 107263019 | 10/2017 |
| CN | 107571022 | 1/2018 |
| CN | 107766647 | 3/2018 |
| DE | 2527141 | 1/1976 |
| DE | 2632716 | 1/1978 |
| DE | 19749939 | 5/1999 |
| DE | 19806608 | 9/1999 |
| DE | 10157143 | 5/2003 |
| DE | 10345597 | 5/2005 |
| DE | 102014117483 | 10/2015 |
| DE | 102014112552 | 3/2016 |
| DE | 102015101352 | 8/2016 |
| DE | 102015112248 | 8/2016 |
| DE | 102017100715 | 7/2018 |
| DE | 102020111386 | 10/2021 |
| DE | 102020123119 | 3/2022 |
| EP | 0634236 | 1/1995 |
| EP | 1739307 | 1/2007 |
| EP | 1988288 | 11/2008 |
| EP | 2063125 | 5/2009 |
| EP | 2952275 | 12/2015 |
| FR | 1284388 | 2/1962 |
| GB | 916155 | 1/1963 |
| JP | S6229781 | 2/1987 |
| JP | 2001522726 | 11/2001 |
| JP | 2002-227821 | 8/2002 |
| JP | 2006263868 | 10/2006 |
| JP | 2009-047153 | 3/2009 |
| JP | 2010-001876 | 1/2010 |
| JP | 2014-62535 | 4/2014 |
| JP | 5711865 | 5/2015 |
| JP | 201513597 | 7/2015 |
| JP | 2016-94907 | 5/2016 |
| KR | 10200000005327 | 1/2000 |
| SU | 1741981 | 6/1992 |
| WO | 0188379 | 11/2001 |
| WO | 2010100134 | 9/2010 |
| WO | 2015021515 | 2/2015 |
| WO | 2018091923 | 5/2018 |
| WO | 2018130718 | 7/2018 |

* cited by examiner

ECCENTRIC SCREW PUMP WITH WORKING ENGAGEMENT AND IDLE ENGAGEMENT AND METHOD FOR CONTROLLING THE ECCENTRIC SCREW PUMP

CROSS-REFERENCE TO FOREIGN PRIORITY APPLICATION

The present application claims the benefit under 35 U.S.C. §§ 119(b), 119(e), 120, and/or 365(c) of German Application No. 102021131427.5 filed Nov. 30, 2021.

FIELD OF THE INVENTION

The invention relates to an eccentric screw pump for delivering solid-laden liquids, having a helically wound rotor, a stator having an inlet and an outlet, in which the rotor is arranged to be rotatable about a longitudinal axis of the stator and which has a helical inner wall corresponding to the rotor, wherein the rotor and stator are arranged and designed with respect to one another in such a way that at least one chamber is formed, which serves to transport the liquid, and the chamber is separated by a sealing line. The eccentric screw pump has a drive motor for rotating the rotor and a control device for controlling the drive motor at least in a working state, in which the rotor is rotated, and in an idle state, in which the rotor does not rotate. The invention furthermore relates to a method for controlling an eccentric screw pump and a computer program for an electronic control unit of an eccentric screw pump.

BACKGROUND OF THE INVENTION

Eccentric screw pumps of the type mentioned at the outset have been known for several years and are used, in particular, to gently deliver and dispense solid-laden liquids, abrasive liquids or, in general terms, highly viscous liquids. They use a single- or multi-threaded helical rotor, which is arranged in a corresponding double- or multi-threaded chamber of a stator and which rotates in said stator. A corresponding configuration of the outer profile of the rotor and the inner profile of the stator results in a constriction, in particular, a sealing line, which seals the at least one chamber, but preferably individual chambers of a multiplicity of chambers with respect to one another. The rotor and the stator may be in direct contact with one another and form a sealing line, or they may also possess a sealing gap separating the chambers in the constriction. In this case, the rotor is generally formed as a single-threaded screw and the stator as a double-threaded screw with a double pitch, thereby realizing the sealing of the individual chambers.

A screw pump is already known from DE2632716 and has a conical screw and a conical pressure casing. In this embodiment, the screw has a conicity of a ca. 30° cone angle, whereby the aim is to achieve an increase in the delivery pressure over a short screw length. In this case, the screw and pressure casing are axially adjustable relative to one another in that the pressure casing is axially movably guided in a sleeve. A pressure should thus be held constant in that the pressure casing is displaced in the pump under the effect of the liquid pressure exerted on a ring part of the pressure casing. This known system is disadvantageous in that it is designed solely for the constancy of the increased pressure, which is generated as a result of the reduction in the cross-sectional area in the delivery direction of the conical pump gap, and does not enable an axial displacement as a function of other influencing variables.

A screw pump is likewise already known from AT223042 and has a conical stator and rotor. By means of a threaded sleeve inserted between the rotor and the driven shaft, in this screw pump, the rotor may be moved axially in relation to the stator by a user turning the sleeve manually through a hand hole using a tool. It is thus possible to correct jamming and also too great a play between the stator and the rotor, caused by a swelling of the stator or wear on the rotor and/or stator respectively.

An eccentric screw pump is already known from DE102015112248A1, in which the gap geometry between the rotor and stator can be changed by readjusting the pre-tension of the stator. In this case, an increased pre-tension results in a compression of the stator, which is formed as an elastomer part, and may thus reduce the gap geometry. This eccentric screw pump is, however, disadvantageous in that the elastomer thicknesses of the stator in both the circumferential direction and the longitudinal direction are different due to the geometry of the stator and an increased pre-tension therefore results in an uneven elastic deformation. Reliable operation of the eccentric screw pump is therefore not ensured and locally increased wear may be generated with this type of adjustment due to the uneven gap geometry.

A similar eccentric screw pump is known from DE 10 2014 112 552 A1. The eccentric screw pump has at least one stator made of an elastic material and a rotor which is rotatable in the stator, wherein the stator is surrounded by a stator casing, at least in certain regions, wherein the stator casing consists of a longitudinally divided casing comprising at least two casing segments and forms a stator tensioning device with which the stator can be tensioned with respect to the rotor in the radial direction, wherein the stator tensioning device has one or more movable adjustment elements, which work on the casing segments to adjust and tension the stator. This pump is notable in that the stator tensioning device has one or more adjustment drives, which are connected to the adjustment elements, or equipped with adjustment elements, for automated engagement of the stator.

In the case of eccentric screw pumps, conical eccentric screw pumps are moreover known, since these enable both simple assembly and a readjustment of the rotor in relation to the stator in the event of wear. Such an eccentric screw pump is known, for example, from WO 2010/100134 A2. To prevent or compensate wear, this document proposes an eccentric screw pump having a conical rotor, which is designed in such a way that the individual chambers all have the same volume in order to prevent or compensate wear. If signs of wear, in particular, so-called cavitations, then appear during operation, it is possible to displace the rotor axially in relation to the stator so that the chamber volumes are the same size again and leak-tightness is achieved.

A further adjustment option is disclosed in DE102014117483A1. An adjustable pump unit for a displacement pump, in particular, for an eccentric screw pump or for a rotary piston pump, is said to be adaptable to a wide variety of operating conditions and delivery tasks. To this end, for its adjustment, the pump unit is formed at least partly from an electroactive and/or temperature-active material and/or is coupled to or equipped with at least one electroactive and/or temperature-active means. Parameters of the displacement pump are preferably set by means of a control device and an electroactive and/or heat-active pump unit coupled thereto, and the elastomer body or the elastomer lining are preferably formed at least partly from an electroactive material and/or coupled to or equipped with at least one electroactive means, and the elastomer body or the lining and/or the at least one electroactive means can be used as sensors, wherein the measurement signals thereof are transmitted to a control device of the displacement pump for the acquisition and/or processing of measurement values.

An eccentric screw pump, which enables an axial adjustability of the rotor, is moreover known from WO2018130718A1 by the present applicant. In this, various structural options are disclosed for enabling an axial adjustment of the rotor and stator relative to one another. Moreover, this document teaches that it is advantageous to temporarily widen the sealing gap between the rotor and stator during operation in order to thereby enable a specific leakage flow. The friction between the rotor and stator can thus be reduced, thereby reducing wear. The leakage flow may moreover be advantageously used for cooling purposes. It is, for example, therefore also possible to set a larger gap when starting up the eccentric screw pump in order to keep friction low in the dry state. It is also possible to operate the eccentric screw pump in an energy saving manner by adjusting for optimum overall efficiency, taking into account the volumetric efficiency and the friction losses. On the other hand, widening the constriction by only a slight amount lends itself to media which are sensitive to shear.

Although these eccentric screw pumps have already proven effective, there is still a need to further improve eccentric screw pumps and adapt them to particular fields of use.

The invention achieves the object in an eccentric screw pump of the type mentioned at the outset by means of an engagement unit, which is designed to set an engagement between the rotor and stator to an idle engagement in the idle state and to a working engagement in the working state, wherein the idle engagement is less than the working engagement.

The invention is based on the knowledge that, in an eccentric screw pump which is stationary for a relatively long time, such as several hours, days, or even occasionally weeks, a relaxation of the elastomer material of the stator, in some cases even a creep, may occur at the contact points between the rotor and a stator made of an elastomer material. In eccentric screw pumps having a stator made of an elastomer material, a pre-tension between the rotor and stator is set so that adequate leak-tightness and a corresponding pump performance is ensured during operation in which significant counter-pressures may occur. The stator is generally formed from a material which is resilient and which may yield in particular under a continuous load. As a result, under a continuous pre-tension at the contact points between the rotor and stator in the idle state, indentations form in the stator, which may have a disadvantageous effect during operation of the eccentric screw pump, in particular, during start-up. This is because, when starting up the eccentric screw pump which has been stationary for a relatively long time, it is necessary to overcome not only the typical start-up torque caused by friction, but also the bulge at the edges of the indentation in the material of the stator which has formed due to the prolonged contact. This is particularly disadvantageous if motors having a limited torque are used as the drive motor. In this regard, the invention proposes reducing the pre-tension between the rotor and stator in the idle state by changing the engagement from the working engagement to the idle engagement and, similarly, from a working pre-tension to an idle pretension, and increasing this again to a working pre-tension in the working state. In particular, the problem of relaxation in elastomer stators is thus reduced or prevented entirely in the idle state. Advantages are moreover revealed during normal start-up of the eccentric screw pump. If the pre-tension is reduced by already changing the engagement from the working pre-tension (working engagement) to the idle pre-tension (idle engagement), the eccentric screw pump may be started with the idle pre-tension and, after one or more revolutions, in particular, after the initial delivery of fluid, the pre-tension may be increased by changing the engagement to the working engagement. The start-up of the eccentric screw pump is thus also simplified and is possible with a low torque. In a manner which is crucial to the present invention, and which differs from the proposal in WO 2018/130718 A1, the engagement between the rotor and stator is always reduced in the idle state. In particular, the engagement is reduced from the working engagement to the idle engagement when the eccentric screw pump has finished operating. The engagement is preferably automatically set to the idle engagement in the idle state and is automatically set to the working engagement in the working state.

However, in other embodiments, the stator may also be formed as a solid stator and preferably from a metallic material. In such a case, a pre-tension between the rotor and stator is not established during operation, but rather a sealing line which is as complete or continuous as possible. The rotor and stator become heated during operation, which can result in expansions. The rotor and stator are generally formed from different materials so that the thermal expansion may be different. When there is close contact between the rotor and stator, with a substantially complete sealing line, bracing may occur during the cool-down post-operation, which may result in deformation of the components to the point where the rotor becomes jammed in the stator. By reducing the engagement between the rotor and stator in the idle state and setting it to an idle engagement according to the invention proposed here, the close contact is eliminated and a gap is established between the rotor and stator so that the described problem of deformation and jamming cannot arise.

The idle pre-tension is less than the working pre-tension. The idle pre-tension is preferably reduced by 10, 20, 30, 40, 50, 60, 70, 80, 90, 100% compared to the working pre-tension. In a preferred embodiment, the idle pre-tension is set in such a way that contact between the rotor and stator is substantially free of tension. (Substantially) free of tension is understood to be a state in which the rotor is in contact with the stator merely as a result of its weight force but the engagement does not result in a pre-tension between the rotor and stator.

A complete sealing line is preferably not formed with the idle engagement. With the working engagement, on the other hand, a complete sealing line is preferably formed between the rotor and stator. With the idle engagement, the eccentric screw pump does not form a completely sealed closure and fluid may flow through the eccentric screw pump from the inlet to the outlet, or vice versa.

The control device, preferably an electronic control device, is preferably part of the eccentric screw pump, although it does not necessarily have to be integrated therewith in a housing. An external control device may also be provided, which is, for example, part of a control centre or is connected thereto. The eccentric screw pump preferably has a housing on or in which a control box with the electronic control is accommodated.

SUMMARY OF THE INVENTION

According to the invention, the engagement unit is provided to set the engagement between the rotor and stator to the idle engagement in the idle state and to the working engagement in the working state. This preferably takes place automatically. For example, the engagement unit may be designed to receive a stop signal for the eccentric screw pump and, in response to receiving the stop signal, to reduce the engagement from the working engagement to the idle engagement. It may also be designed to receive a start signal for the eccentric screw pump and, in response to receiving the start signal, to increase the engagement from the idle engagement to the working engagement.

In one variant, the electronic control device is provided both for controlling the drive motor and for changing the pre-tension. In this case, the electronic control device may comprise the engagement unit, which may be designed for example as a software module.

However, the engagement unit may also comprise an electronic engagement control and preferably an engagement drive, which is actuated by the electronic engagement control to change the engagement. In such an embodiment, the control unit does not have to be provided at the same site to actuate the drive motor and the engagement control. It is also conceivable that, in a simple embodiment, the control device for the drive motor is formed by hard-wired switches. However, it is preferably provided that the engagement unit automatically reduces the engagement from the working engagement to the idle engagement when the drive motor switches from the working state to the idle state. For example, if an operator activates a start button of the eccentric screw pump, the electronic control unit controls the drive motor in such a way that this switches from the idle state to the working state and the rotor rotates. The engagement unit simultaneously and automatically increases the engagement from the idle engagement to the working engagement. If an operator in turn now activates a switch for stopping the eccentric screw pump, or if this is triggered by a superordinate control unit, the electronic control unit controls the drive motor in such a way that the rotor stops rotating and the drive motor switches from the working state to the idle state. The engagement unit simultaneously automatically controls the engagement in such a way that it is reduced from the working engagement to the idle engagement.

The engagement unit is preferably designed to adjust the engagement from the working engagement to the idle engagement in a run-down time period or thereafter. The run-down time period preferably comprises a switch from the working state to the idle state. For example, the run-down time period is defined by a time from a stop signal being received to a complete standstill of the rotor. It typically takes between several and a few revolutions of the rotor to reach a complete standstill of the rotor after a stop signal is received. The engagement is preferably reduced from the working engagement to the idle engagement within this run-down time period. However, it is likewise preferred if the engagement unit is designed to adjust the engagement from the working engagement to the idle engagement when the complete standstill of the rotor is reached, in particular, immediately thereafter or following a first predetermined idle time after the complete standstill is reached. For example, it may be provided that the engagement is adjusted from the working engagement to the idle engagement within 1, 2, 3, 4, 5, 10, 15, 20, 30, 60 seconds or 1, 2, 3, 5, 10, 20, 30 minutes. It may be advantageous to not adjust the engagement from the working engagement to the idle engagement immediately once the rotation has stopped and the complete standstill has been reached, since it is possible that, shortly thereafter, the eccentric screw pump may again be set in operation and the rotor set in rotation. So that the engagement is not reduced with each brief interruption of a pump procedure, it is possible to specify such a predetermined idle time which must firstly elapse before the engagement is reduced from the working engagement to the idle engagement. This is particularly useful if the pump is designed for a higher operating pressure.

Conversely, the engagement unit is preferably designed to adjust the engagement from the idle engagement to the working engagement in a run-in time period or thereafter. The run-in time period preferably comprises a switch from the idle state to the working state. If the eccentric screw pump is in the idle state and the engagement is reduced from the working engagement to the idle engagement, and the eccentric screw pump is now started such that the rotor should rotate, the engagement is increased from the idle engagement to the working engagement. The run-in time period may be defined as a time period which starts when a start signal is received and continues until a setpoint speed is reached. The engagement is preferably also increased from the idle engagement to the working engagement within this run-in time period. It is also possible to increase the engagement from the idle pre-tension to the working pre-tension only when the setpoint speed has been reached, or to wait an additional wait time, for example 1, 2, 3, 5 or 10 seconds after reaching the setpoint speed until the engagement is increased to the working engagement.

The electronic engagement control may also receive a start signal from a superordinate control centre and emit a release signal to the control centre when the engagement is the idle engagement. However, the start signal, and likewise the stop signal, may also be simply looped through, and the electronic engagement control receives the signal independently of the console centre or the electronic control device for the drive motor and adjusts the engagement automatically according to the operating state.

In a further alternative, the engagement unit is of hydraulic design. This is particularly preferred if the drive motor is likewise of hydraulic design. For example, in this case, the engagement unit comprises a hydraulic path via which a hydraulic medium may be received, and a hydraulic drive, which is coupled to the rotor and/or stator to adjust the engagement.

In a preferred embodiment, the rotor is of tapered design and preferably has a conical form. Alternatively to this, the rotor may also have varying eccentricities. The rotor preferably tapers towards the outlet. It may likewise be preferred if the eccentricities decrease or increase towards the outlet. The reverse configuration is also possible, with the rotor tapering towards the inlet and the eccentricities increasing or decreasing towards the inlet.

In both variants, an adjustment of the engagement may take place via an axial displacement of the rotor and stator relative to one another. If, for example, the rotor and stator are of conical design, the rotor may be displaced towards the tapering end in relation to the stator in order to increase the engagement. The stator may also be displaced towards the widening end of the rotor in order to increase the engagement. Of course, it is also possible to displace both the rotor and the stator. However, displacing the rotor may have certain structural advantages. In this regard, when displacing the stator, it is, in particular, necessary to ensure that the stator is still sealed with respect to adjoining housing parts. An adjustment of the rotor can be easily achieved, for example, by the measures described in WO 2018/130718. These measures may also be combined.

In a further preferred embodiment, the stator is radially engageable in order to adjust the engagement between the working engagement and the idle engagement. This embodiment is based on the idea that the engagement between the rotor and stator may also be set or increased by compressing the stator radially. To this end, it may be provided that the stator comprises a supporting element and an elastomer part, wherein, at least in certain regions, the supporting element surrounds the elastomer part in its entirety. The supporting element is preferably formed from a metal and supports the elastomer part radially. To now influence the radial engagement, it may furthermore be provided that two adjustment elements are provided on the stator, for example at the axial end faces of the stator, which adjustment elements have a variable mutual spacing. A mechanical coupling and/or a connection is preferably provided between the adjustment elements so that, by altering the relative distance between the two adjustment elements, it is possible to change the cross section and the length of the elastomer part of the stator. Therefore, if the two adjustment elements are moved towards one another, for example, the elastomer part is compressed axially, whereby a radial expansion of the elastomer part is realized both radially outwards and radially inwards. Since the supporting element is provided on the radially outer side, the axial compression of the elastomer part only results in a radially inward expansion of the elastomer part, so that the pre-tension between the rotor and stator is increased. Conversely, by positioning the adjustment elements further apart from one another, the pre-tension may be reduced again. In this case, the axial length of the elastomer part is preferably selected such that the idle pre-tension is set without compression of the elastomer part or with the adjustment elements in a neutral position.

In a second aspect, the invention achieves the object mentioned at the outset by a method of the type mentioned at the outset for controlling an eccentric screw pump, preferably an eccentric screw pump according to one of the above-described preferred embodiments of an eccentric screw pump according to the first aspect of the invention. The method preferably comprises the steps: operating the eccentric screw pump in a working state, comprising: rotating a rotor in a stator of the eccentric screw pump with a working engagement between the rotor and stator; outputting a stop signal and, in response to the stop signal: stopping the rotation and switching to an idle state of the eccentric screw pump; and reducing the engagement between the rotor and stator from the working engagement to an idle engagement.

It should be understood that the eccentric screw pump according to the first aspect of the invention and the method according to the second aspect of the invention have identical and similar sub-aspects, as set down, in particular, in the dependent claims. In this regard, for preferred features of the eccentric screw pump and the method and the advantages thereof, please refer to the above description in its entirety.

The stop signal may be provided by an operator of the eccentric screw pump, a superordinate control unit, a program part of the electronic control unit of the eccentric screw pump or the like. An operator may output the stop signal via a button or a remote control, for example, which stop signal is then received at an electronic control unit of the eccentric screw pump and/or a drive motor of the eccentric screw pump. It may also be provided that a superordinate control, for example, a system control, a control centre, or the control of a vehicle in which the eccentric screw pump is mounted, outputs the stop signal. It may also be provided that an operating plan is installed in the electronic control unit of the eccentric screw pump itself, which operating plan prompts the operation of the eccentric screw pump according to predetermined criteria, for example, a time plan. A stop signal may furthermore be output, for example, by a sensor or the eccentric screw pump or a unit arranged upstream or downstream.

The steps of stopping the rotation and reducing the engagement may be executed simultaneously or partly or completely sequentially. They preferably follow the output of the stop signal immediately and in response thereto.

The eccentric screw pump preferably remains in an engagement which corresponds to the idle engagement until the eccentric screw pump is next started. This means that the idle engagement of the eccentric screw pump is always maintained in the switched-off state. The above-mentioned advantages are thus achieved and, in particular, the relaxation caused by pre-tensioned contact between the rotor and stator is prevented.

If, to reduce the engagement from the working engagement to the idle engagement, an axial position between the rotor and stator is changed and, in particular, the rotor and/or stator moves from a working position to an idle position, the working position and the idle position are spaced apart by at least $1/50$, $1/40$, $1/30$, $1/10$, $1/5$, $1/4$ of the pitch of the rotor. It is preferred if the idle pre-tension is less than the working pre-tension. The idle pre-tension is preferably reduced by 10, 20, 30, 40, 50, 60, 70, 80, 90, 100% compared to the working pre-tension.

In a preferred embodiment, the method comprises the steps: outputting a start signal and, in response to the start signal: beginning the rotation of the rotor and switching from the idle state to the working state of the eccentric screw pump. The method preferably comprises, in response to the start signal: increasing the engagement between the rotor and stator from the idle engagement to the working engagement. The steps of beginning the rotation and increasing the engagement may be executed simultaneously or partly or completely sequentially.

In a third aspect, the invention achieves the object mentioned at the outset by means of a computer program comprising program codes, which, when executed on an electronic control unit of an eccentric screw pump, preferably an eccentric screw pump according to one of the above-described preferred embodiments of an eccentric screw pump according to the first aspect of the invention, prompts the electronic control unit to execute the method according to one of the above preferred embodiments of a method according to the second aspect of the invention.

It should, in turn, be understood that the computer program according to the third aspect of the invention, the method according to the second aspect of the invention and the eccentric screw pump according to the first aspect of the invention have identical and similar sub-aspects, as set down in particular in the dependent claims. In this regard, for the computer program according to the third aspect of the invention, please refer to the above descriptions of the first and second aspect of the invention in their entirety. Embodiments of the invention are now described below with reference to the drawings. These are not necessarily intended to be drawn to scale; rather, the drawings have a schematic and/or slightly distorted form where this is useful for explanation. With regard to additions to the teaching which can be identified directly from the drawings, please refer to the appropriate prior art. In this case, it should be taken into account that various modifications and alterations relating to the form and detail of an embodiment may be undertaken without deviating from the general idea of the invention. The features of the invention which are disclosed in the description, in the drawings and in the claims may be fundamental to the development of the invention both individually and in any combination. Moreover, all combinations of at least two of the features disclosed in the description, the drawings and/or the claims fall within the scope of the invention. The general idea of the invention is not limited to the exact form or the detail of the preferred embodiments shown and described below or limited to subject matter which would be restricted compared to the subject matter claimed in the claims. For the given measurement ranges, values lying within the said limits shall also be disclosed as limit values and can be used and claimed as required. For the sake of simplicity, the same reference signs are used below for identical or similar parts or parts having an identical or similar function.

BRIEF DESCRIPTION OF THE DRAWINGS

Further advantages, features, and details of the invention are revealed in the description below of the preferred embodiments and with reference to the drawing, in which.

DETAILED DESCRIPTION OF THE EMBODIMENTS

Figure 1:
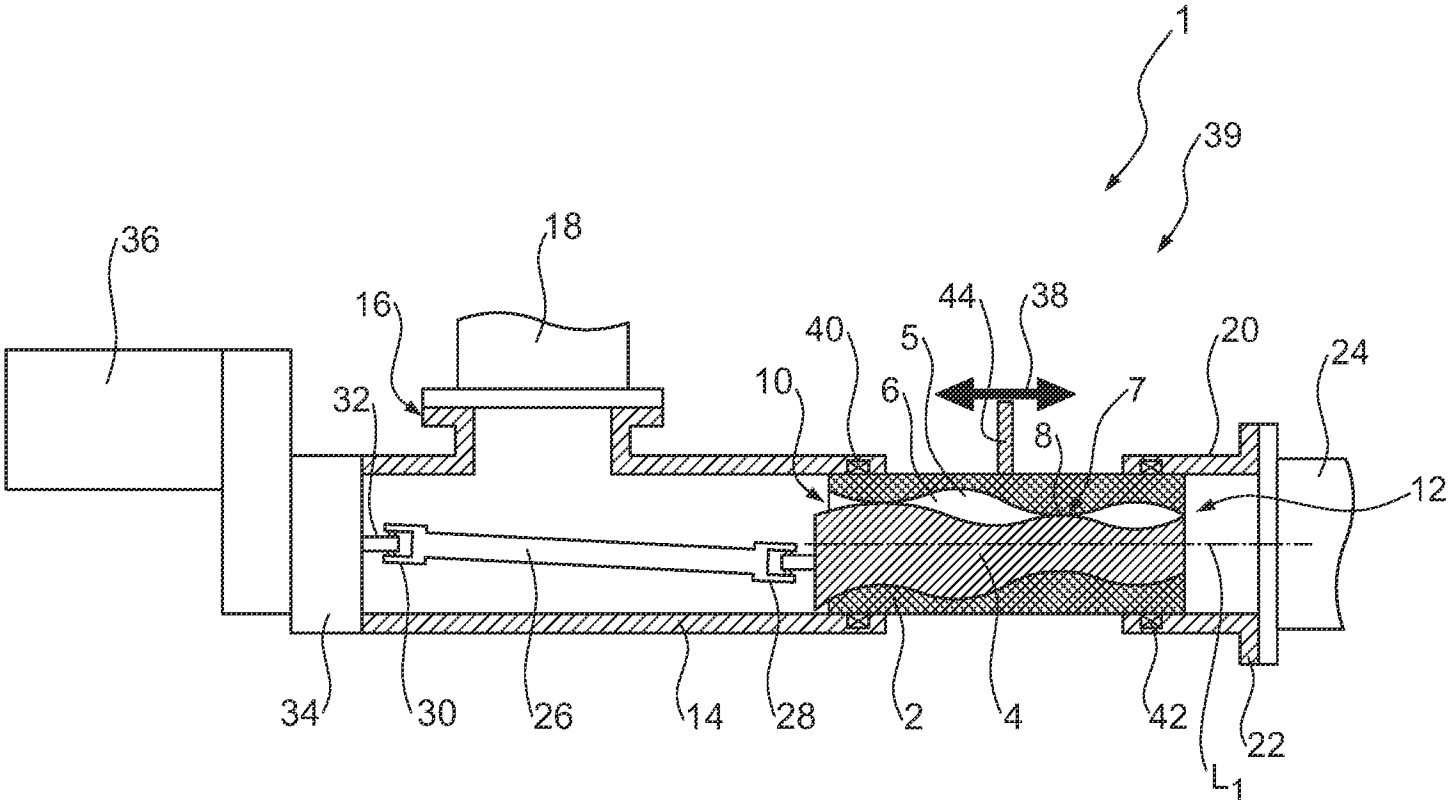
FIG. 1 shows a schematic cross section through an eccentric screw pump according to a first exemplary embodiment.

An eccentric screw pump 1 has a stator 2 and a rotor 4. The stator has a central axis L1, which extends centrally through an inner cavity 6 of the stator 2. The stator 2 has an inner wall 8, which delimits the cavity 6 and is formed from an elastomer material. The inner contour of the wall 8 is formed such that it defines a double-threaded helix. The rotor 4 likewise has a helical shape overall, wherein the pitch of the helix form of the stator 2 is double the pitch of the rotor 4. Individual chambers 5 are thus formed, which are separated by a constriction 7.

The stator 2 furthermore has an inlet 10 and an outlet 12. The inlet 10 is connected to an inlet housing 14, which has an inlet flange 16 on which an inlet pipe 18 is flange-mounted. The outlet 12 is furthermore provided with an outlet housing 20, which has an outlet flange 22 on which an outlet pipe 24 is flange-mounted.

The embodiment shown in FIG. 1 relates to a stationary eccentric screw pump, which is, in particular, installed in the system in a fixed manner. The inlet pipe 18 may merge into a further pipeline, for example, waste water pipeline, and the outlet pipe 24 may merge into another further pipeline or a collecting tank.

A drive shaft 26 extends through the inlet housing 14, which drive shaft 26 is connected to the rotor 4 via a first Cardan joint 28 and communicates with a driven shaft 32 of a gear system 34 via a second Cardan joint 30. Instead of such a drive shaft 26 having two Cardan joints 28, 30, it is likewise preferable to use a thin flexible shaft which enables the eccentric drive. The gear system 34 is connected, on the input side, to a drive motor 36 which, according to this exemplary embodiment, is designed as an electric motor. However, the drive motor 36 may also be connected directly to the driven shaft 32, without an interconnected gear system 34. The drive motor 36 may also be arranged at a spacing, or axially offset, from the driven shaft 32 and/or the gear system 34 and may communicate therewith, for example, via a belt drive. As a further alternative, the drive motor 36 is designed as a hydraulic machine 204 (c.f., FIG. 6), for example, as a Gerotor motor.

The eccentric screw pump 1 has an engagement unit 39 for adjusting the engagement between the rotor 4 and stator 2. According to this exemplary embodiment (FIG. 1), the engagement unit 39 is designed such that the stator 2 is axially displaceably mounted. The stator 2 is displaceable along the longitudinal axis L1, as indicated by the arrow 38. To this end, the stator 2 is received in portions of the inlet housing 14 and the outlet housing 20 which are sealed with a seal 40, 42. For the displacement of the stator 2, the engagement unit 39 has a contact portion 44, which may communicate with an engagement drive (not shown in FIG. 1) which is provided for this purpose.

FIGS. 2*a*, 2*b*, and 2*c* and 3*a*, 3*b*, and 3*c* illustrate the alteration to the engagement, i.e., also an adjustment of the constriction 7, with reference to a schematic illustration.

Figures 2A, 2B, 2C:
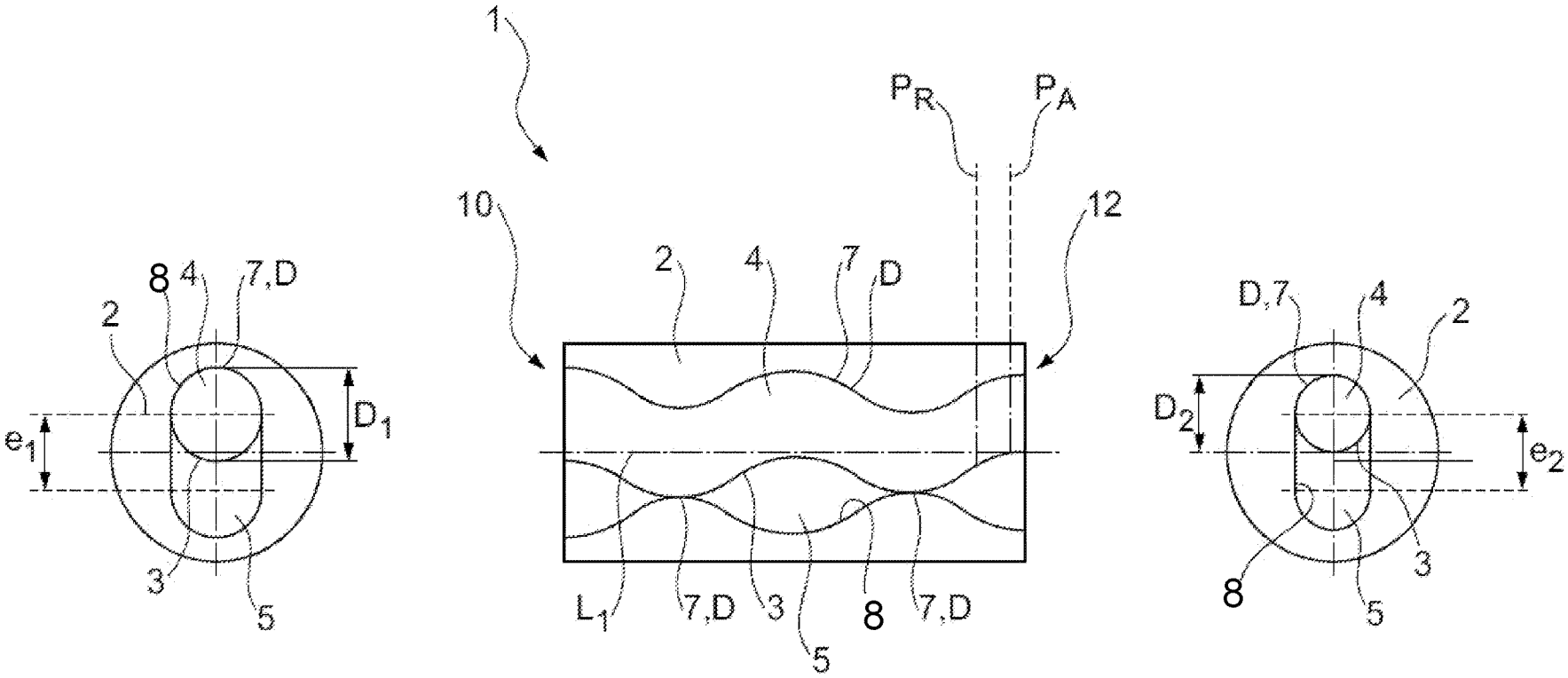
FIG. 2*a* shows a schematic cross section through an eccentric screw pump perpendicularly to the longitudinal axis when set in working engagement.
FIG. 2*b* shows a schematic cross section along the longitudinal axis according to FIG. 2*a;*
FIG. 2*c* shows a schematic cross section perpendicularly to the longitudinal axis according to FIG. 2*a;*
Figures 3A, 3B, 3C:
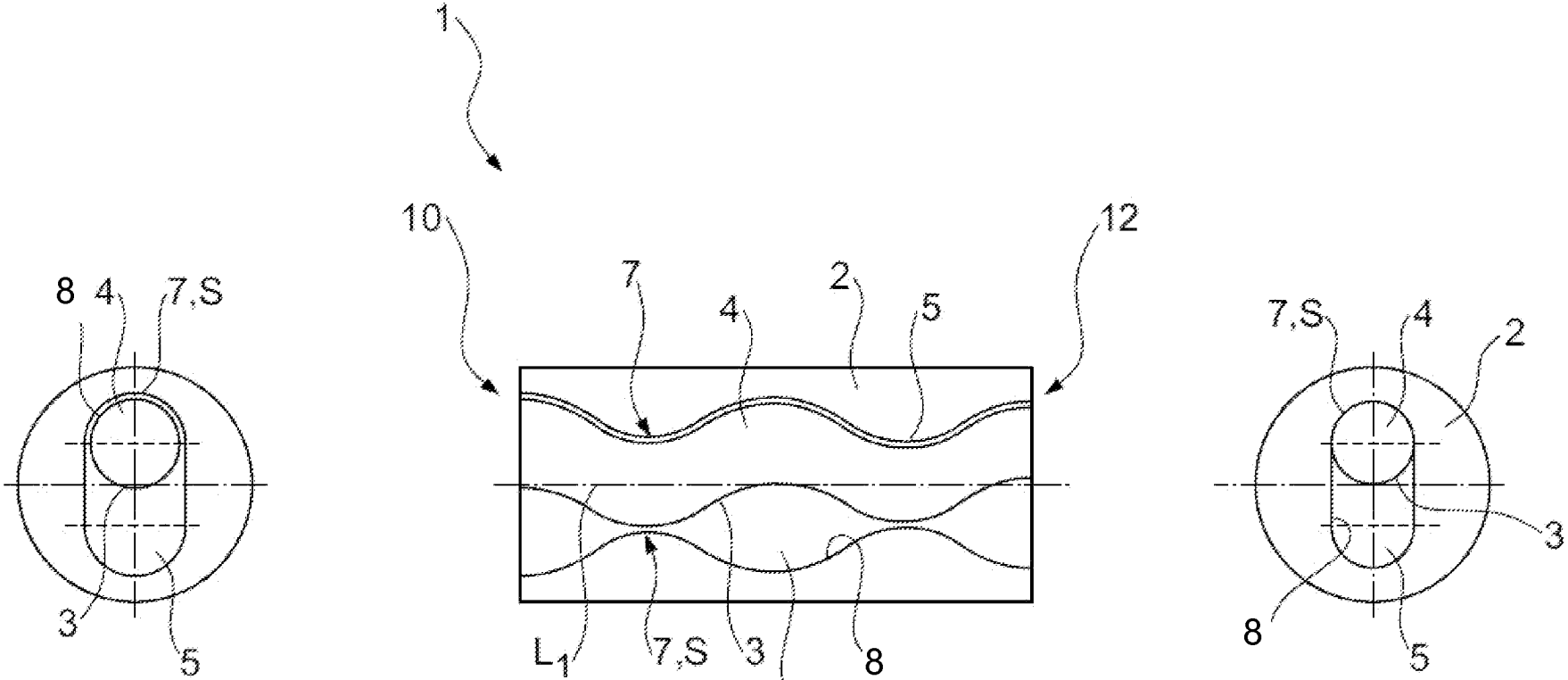
FIG. 3*a* shows a schematic cross section through an eccentric screw pump perpendicularly to the longitudinal axis when set in idle engagement.
FIG. 3*b* shows a schematic cross section along the longitudinal axis according to FIG. 3*a;*
FIG. 3*c* shows a schematic cross section perpendicularly to the longitudinal axis according to FIG. 3*a;*

Whilst FIGS. 2*a*-2*c* show an engagement between the rotor 4 and stator 2, which corresponds to a working engagement and in which there is contact between the rotor 4 and stator 2, FIGS. 3*a*-3*c* illustrate an idle position with a widening so that a gap S is established. FIG. 2*b* shows a section along the longitudinal axis L1, as is also illustrated in FIG. 1. The rotor 4 is in a maximum upper position with respect to FIGS. 2*a*-2*c*, which can be seen, in particular, with reference to FIGS. 2*a* and 2*c*, which each show sections perpendicularly to the longitudinal axis L1. FIG. 2*a* shows a section near to the inlet 10 and FIG. 2*c* shows a section at the outlet 12. As can be seen in particular with reference to FIGS. 2*a* and 2*c*, the rotor 4 abuts against an inner wall 8 of the stator 2 with a portion of its circumferential surface 3. A sealing line D is formed in the constriction 7 as a result of the contact. The working engagement, which here is a working pre-tension between the rotor 4 and stator 2, ensures that the sealing line D is substantially continuous during operation. It is generally provided that the rotor 4 is positioned in the stator 2 in such a way that a pre-tension is produced in the radial direction. The stator 2 is formed from a flexible material, in particular, such as an elastomer. A pre-tension in the radial direction consequently results in an elastic deformation of the stator 4 in the region of the sealing line D, in particular, at points with a more punctiform contact or a smaller contact surface compared to points with a more planar contact.

As a result of an axial adjustment of the rotor 4, which is of conical design overall in this exemplary embodiment, it is possible to widen the constriction 7 and thus reduce a radial pre-tension from the working engagement or working pre-tension to the idle engagement or idle pre-tension or even to establish a gap S instead of a sealing line D. The reduction in the engagement is achieved by a displacement of the rotor 4 in the direction of the conical widening, i.e., to the left with reference to FIGS. 2*a*-3*c*. The constriction 7 is thus widened and the idle engagement (c.f., FIGS. 3*a*-3*c*) may be set.

The working position PA and the idle position PR of the rotor 4 relative to the stator 2 are shown in FIG. 2*b* and FIG. 3*b*, respectively. In this exemplary embodiment, the working position PA and the idle position PR are spaced apart by ¼ of the pitch of rotor 4 (the pitch is understood to be the distance between two crests or two roots in section). This distance is generally sufficient to ensure a reliable idle engagement. As can be easily seen from FIGS. 2*a*-2*c*, a high pressure prevails in particular at points at which the contour of the rotor runs counter to the contour of the stator (in FIG. 2*b*, in particular, at the points which are denoted by 7, D in the lower region). In the idle state of the eccentric screw pump, when the rotor 4 is not driven by the drive motor 36, a relaxation or, in the worst case, a creep of the material of the stator 2 may occur in particular at these points. This results in changes to the internal geometry of the stator 2, in particular, such as indentations in the material of the stator 2, which do not recede immediately after operation resumes. Although these indentations usually recede again during operation, this may take several minutes or hours. The start of the operation is particularly problematic, when the drive motor 36 not only has to overcome the breakaway torque due to the friction between the rotor 4 and stator 2, but the rotor 4 also has to move out of the depression(s) or indentation(s) which have formed. For this reason, the invention provides that the engagement, and therefore also the pre-tension between the rotor 4 and stator 2, is set to the idle engagement or idle pre-tension in the idle state and to the working engagement or working pre-tension in the working state, wherein the idle engagement or idle pre-tension is less than the working engagement or working pre-tension.

In this exemplary embodiment (FIGS. 2*a*-3*c*), the eccentricity e1, e2 is constant, whereas the diameter D1, D2 of the rotor 4 decreases in the direction of the outlet 12. This means that e1 and e2 are identical, whereas D1 is greater than D2. However, embodiments are also included, in which the diameter is constant, i.e., D1 is identical to D2, and the eccentricity changes, i.e., for example, e1 is greater than e2. This has a corresponding effect during the axial displacement. It is likewise possible that both the diameter and the eccentricity are altered over the length.

The engagement and therefore the pre-tension may also be adjusted in that the stator 2 is squeezed in the axial direction in order to thereby generate a radial widening of the stator 2. To this end, adjustment elements (not shown here) may be provided, for example, at axial end faces of the stator, which adjustment elements have a variable mutual spacing, wherein a mechanical coupling and/or connection is established between the adjustment elements and the stator so that, by altering the relative distance between the two adjustment elements, it is possible to change the cross section and the length of the elastomer part of the stator. The adjustment elements may be formed, for example, as circular pressure plates, which are connected to one another via tension rods. It is also possible to integrate electroactive polymers in the stator 2, which bring about a radial expansion of the stator 2 when a voltage is applied.

Figure 4:
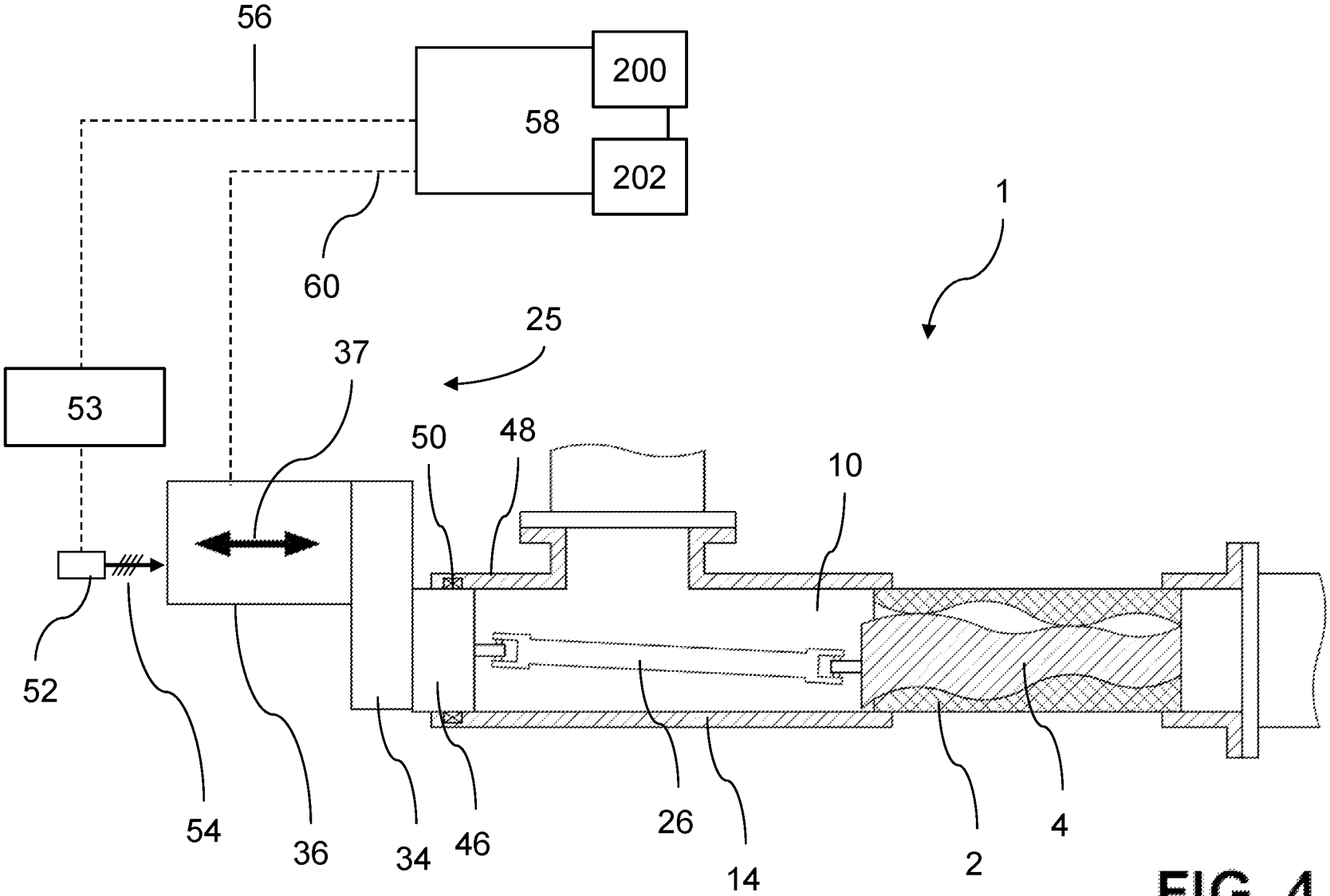
FIG. 4 shows a schematic cross section through an eccentric screw pump according to a second exemplary embodiment.

FIG. 4 shows an exemplary embodiment which is modified with respect to FIG. 1, wherein similar elements are denoted by the same reference signs. In this regard, please refer to the above description of the first exemplary embodiment (FIG. 1) in its entirety. With regard to the pre-tension between the rotor 4 and stator 2, please refer to FIGS. 2*a*-3*c*.

In contrast to the first exemplary embodiment, in this exemplary embodiment (FIG. 4), the engagement unit 39 is designed such that the rotor 4 is axially displaceable, specifically together with the complete drive train 25, which, according to this exemplary embodiment, consists of the drive shaft 26, the gear system 34, and the drive motor 36, even though all three of these elements are optional. In this regard, the arrow 37 indicates that the drive motor 36 is also displaced. To this end, the housing 46 of the gear system 34 is displaceably mounted in a portion 48 of the inlet housing 14 which is opposite the inlet 10 of the stator 2 and is sealed with respect to the surrounding environment by a seal 50. In the event that a gear system 34 is not present, the drive motor 36 may also be mounted directly on the portion 48 or by means of a motor mount.

For the purpose of displacing the rotor 4 in the axial direction, a separate engagement drive 52 is provided, which may displace the drive train 25 (or only the drive motor 36 in the event that a gear system 34 is not provided) for example via a spindle drive 54 (shown merely schematically) such that the engagement between the rotor 4 and stator 2 may be adjusted from the working engagement to the idle engagement and vice versa.

To this end, an electronic engagement control 53 is preferably connected to an electronic control device 58 of the eccentric screw pump 1 or the drive motor 36 via a signal line 56. The drive motor 36 is moreover connected to the electronic control device 58 via a signal line 60. The electronic control device 58 may be, for example, part of a control centre or receives via a receiving or input interface 200, via which control or regulating data are input or received, and is designed to execute the control or regulation depending on this control or regulating data. For example, a setpoint volume or a difference between a setpoint volume and an actual volume may be input into the electronic control device 58 via this input interface 200. In this case, the input interface 200 may be a user interface or an interface to a superordinate unit, for example a control centre. Additionally or alternatively, an input connection 202 may be provided for connecting a sensor, switch, and/or superordinate control unit. The electronic engagement control 53 receives a start signal from the electronic control unit or directly from a superordinate unit, which start signal has the effect of starting the drive motor 36 and controls the engagement drive 52 automatically on the basis thereof, which then sets the engagement to the working engagement. The electronic engagement control 53 likewise receives a stop signal, which has the effect of stopping the drive motor 36 and controls the engagement drive 52 automatically on the basis thereof, which then sets the engagement to the idle engagement.

In other embodiments, the electronic control unit 58 and the engagement control 53 may also be integrated in one control.

Figure 5:
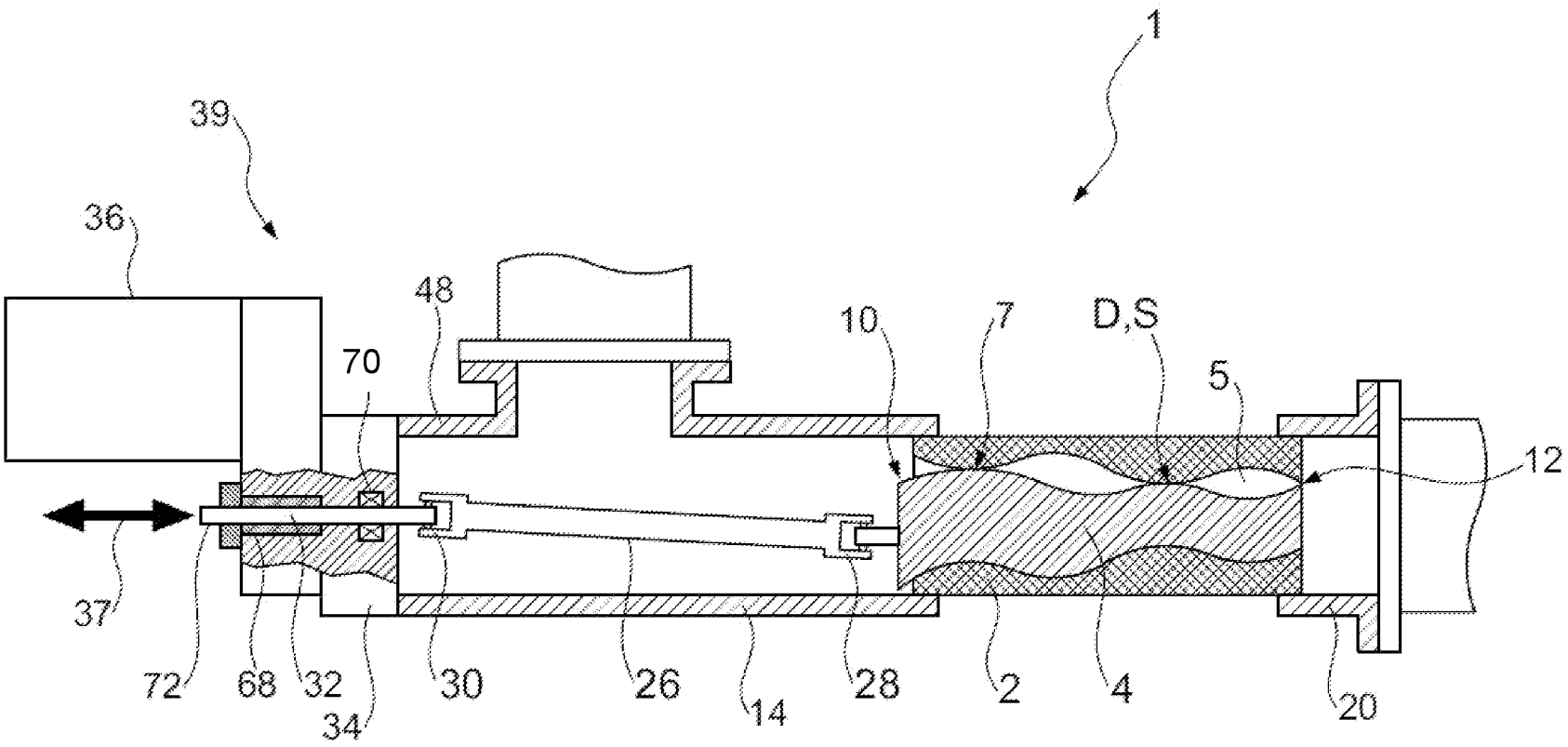
FIG. 5 shows a schematic cross section through an eccentric screw pump according to a third exemplary embodiment.

FIG. 5 shows a further exemplary embodiment, which is essentially similar to the exemplary embodiment of FIG. 4. Identical and similar elements are in turn denoted by the same reference signs, so please refer to the above description in its entirety. It should be understood that the electronic control unit 58 described with reference to FIG. 4 is likewise provided in the eccentric screw pump 1 according to FIG. 5.

According to this exemplary embodiment (FIG. 5), the rotor 4 is in turn arranged to be displaceable with respect to the stationary stator 2. However, in this exemplary embodiment, the drive motor 36 is likewise stationary and non-displaceable. Overall, the drive shaft 26 is in turn coupled to the driven shaft 32 of the drive motor 36 via a Cardan joint 30. To enable a displacement of the rotor 4 and drive shaft 26, the driven shaft 32 is axially displaceably mounted in the gear system 34, in particular, in a driven gear 68 of the gear system 34. The driven gear 68 is coupled to the driven shaft 32 by an axially displaceable shaft-hub connection. The gear system 34 is therefore equipped with a gear 68 which is designed as a hollow shaft and in which the driven shaft 32 may be displaced. Alternatively, the driven gear 68 may also be displaceable in the gear system 34 and rigidly connected to the driven shaft 32. The driven shaft 32 is in turn guided through a seal 70 so that liquid cannot penetrate into the gear system 34 from the drive inlet housing 14. A drive 52 (c.f., FIG. 4) may in turn be arranged on an outwardly lying portion 72 of the driven shaft 32 in order to enable the axial displacement of the driven shaft 32 and therefore the rotor 4.

Figure 6:
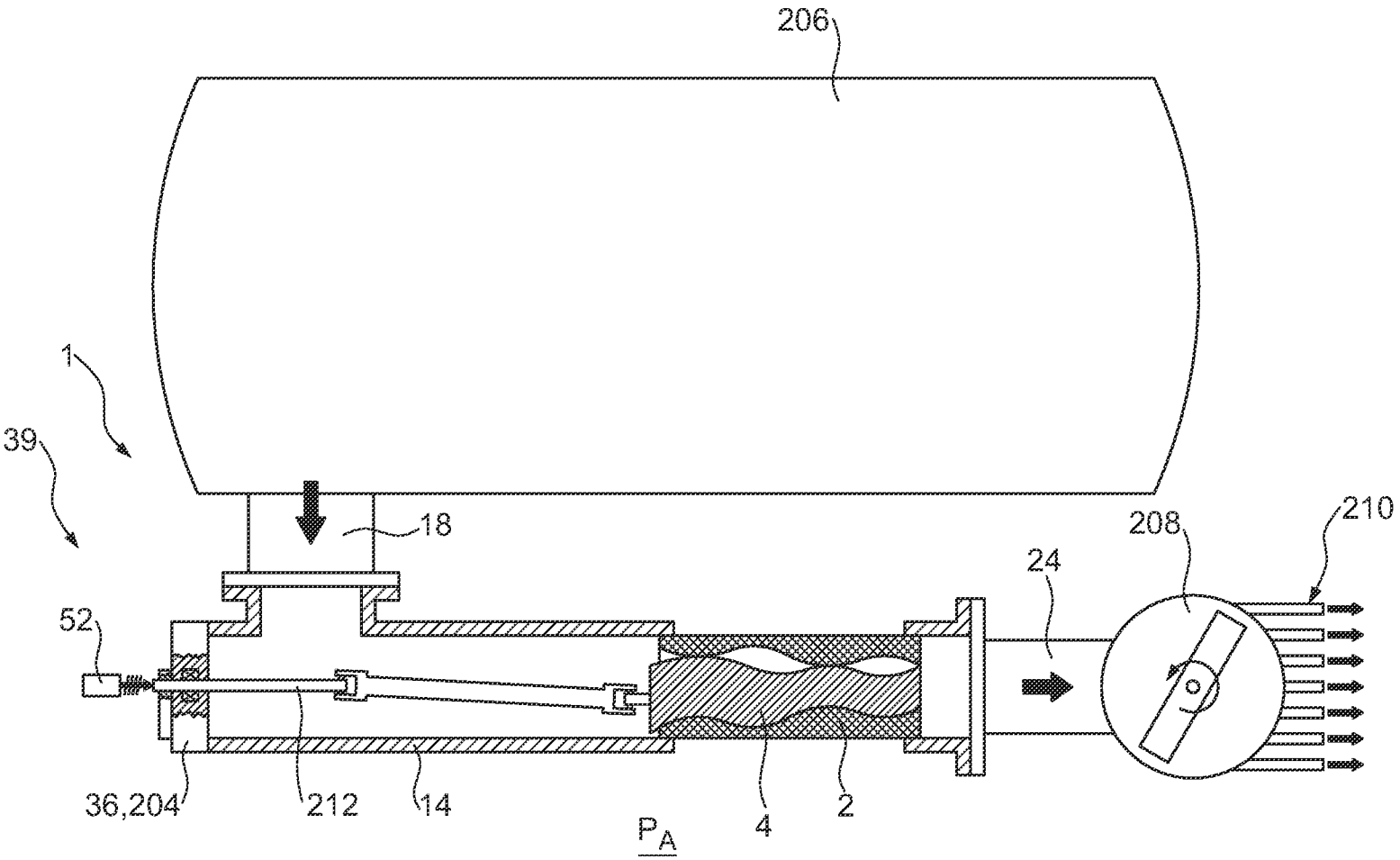
FIG. 6 shows a schematic cross section through an eccentric screw pump according to a fourth exemplary embodiment with a working engagement.

A further embodiment of the invention, which is based on the previous embodiments, is shown in FIG. 6. Identical and similar elements are denoted by the same reference signs as those in the previous exemplary embodiments, so, in this regard, please refer to the above description in its entirety.

Figure 7:
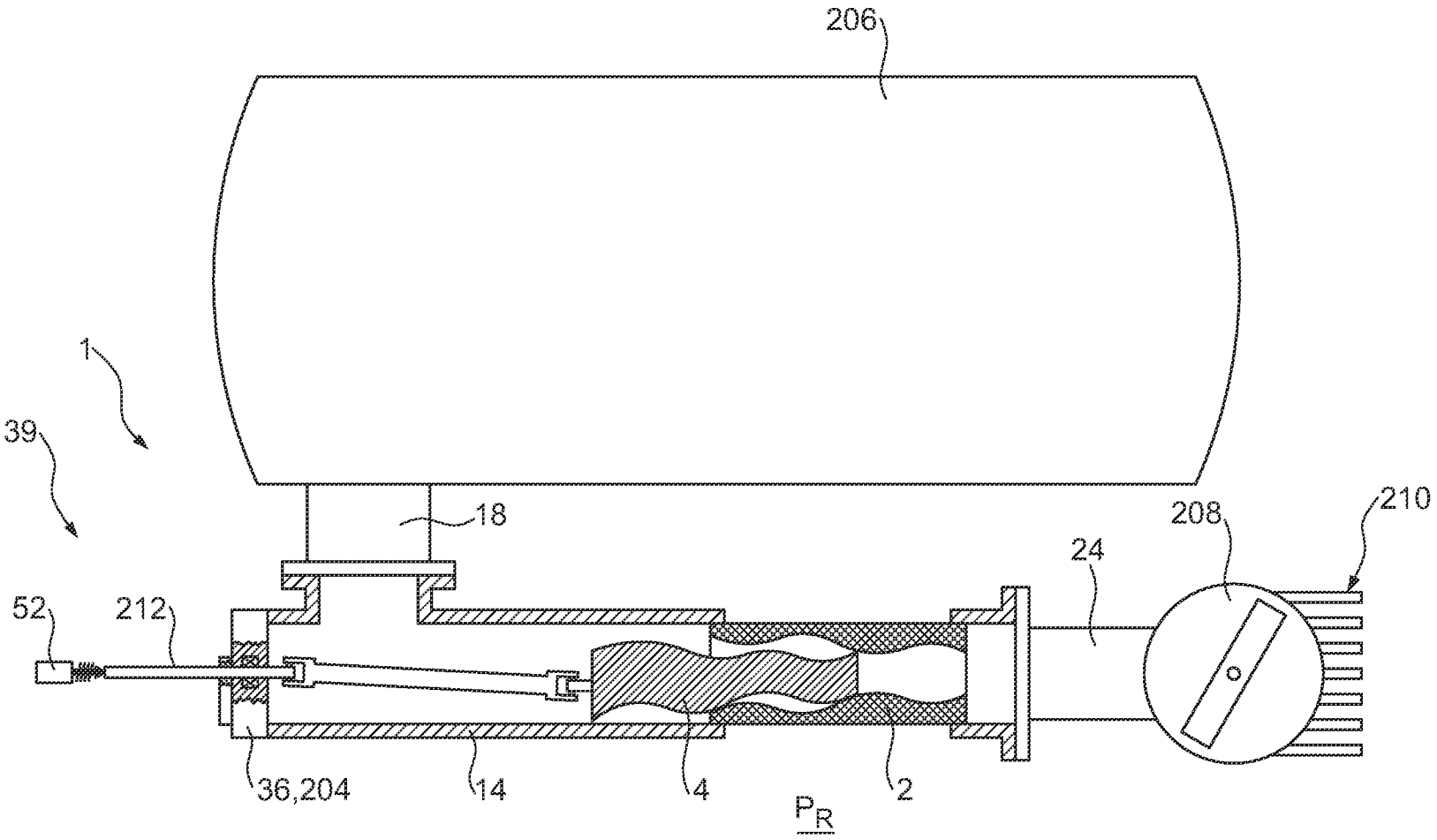
FIG. 7 shows a schematic cross section through an eccentric screw pump according to the fourth exemplary embodiment with an idle engagement.

In FIGS. 6 and 7, the eccentric screw pump 1 is firstly not designed as a stationary pump, but is part of an agricultural trailer, which supports a slurry tanker 206. The slurry tanker 206 is connected to the inlet pipe 18. The outlet pipe 24 is connected to a spreader 208 and a dribble bar linkage 210. A particularly preferred embodiment is thus formed, which may also be implemented with the other embodiments of eccentric screw pumps 1 disclosed herein. An eccentric screw pump is particularly suitable for delivering slurry, since slurry contains solid substances and is therefore not easily pumpable.

A further difference from the previous exemplary embodiments is that the drive motor 36 here is designed as a hydraulic machine 204. The hydraulic machine 204 may be connected to a hydraulic source (not shown, see FIGS. 8 and 9 for this) of the agricultural trailer via a supply line and a return line (not shown) and thus supplied with hydraulic medium under pressure.

In one example, the hydraulic machine 204, like the drive motor 36 according to the exemplary embodiment of FIG. 4, may be displaceably mounted on the pump housing 14 and axially displaced via a drive 52 in order to bring the rotor 4 into the working position PA (FIG. 6) and the idle position PR (FIG. 7) in order to thereby be able to set the working engagement or working pre-tension and the idle engagement or idle pre-tension. The engagement drive 52 is then in turn connected to the electronic engagement control 53 (not shown in FIGS. 6, 7). The hydraulic machine 204 may be driven solely via the supplied pressure so that the electronic control device 58 does not actuate the hydraulic machine 203 directly, but rather a hydraulic pump (not shown here) for supplying a hydraulic pressure.

In FIGS. 6 and 7, a hydraulic driven shaft 212 is displaceably mounted in the hydraulic machine 204. The hydraulic driven shaft 212 is then in turn connected to the drive shaft 26 via the second Cardan joint 30. The hydraulic driven shaft 212 is accordingly displaceably mounted in a hollow shaft of the hydraulic machine.

Figure 8:
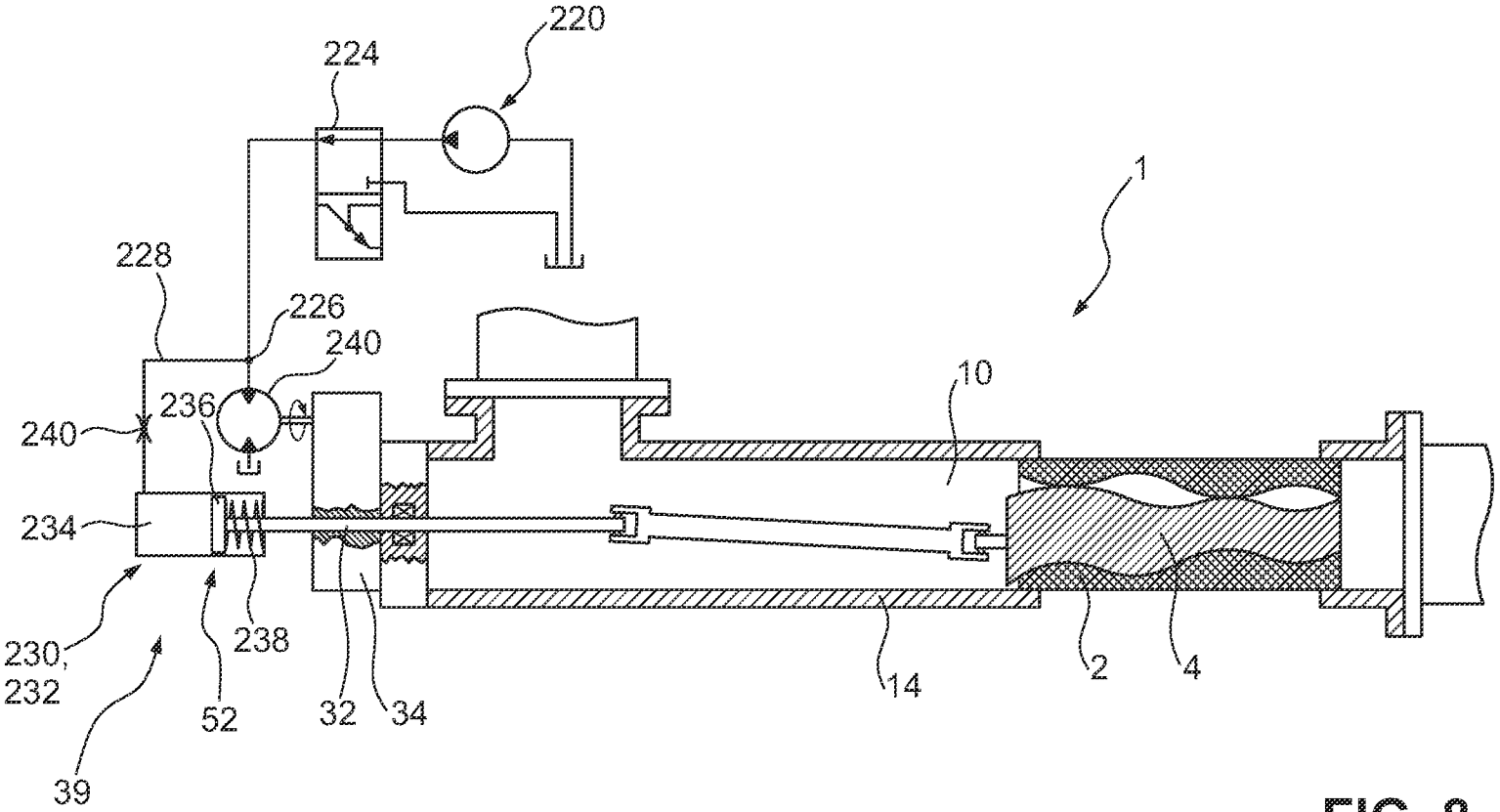
FIG. 8 shows a schematic cross section through an eccentric screw pump according to a fifth exemplary embodiment.
Figure 9:
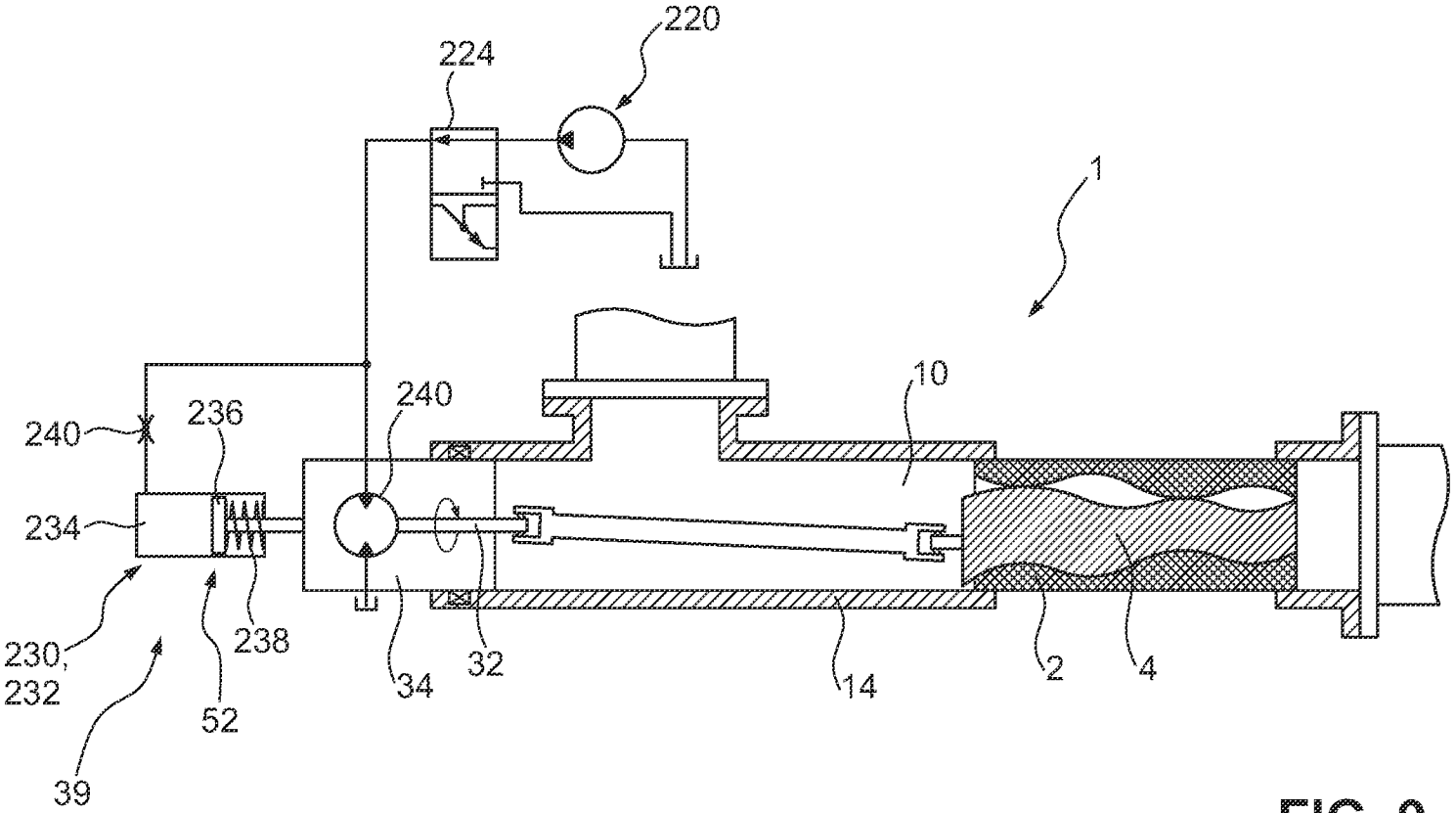
FIG. 9 shows a schematic cross section through an eccentric screw pump according to a sixth exemplary embodiment.

FIGS. 8 and 9 show two variants, in which the drive motor is designed as a hydraulic machine 204 and the engagement unit 39 is of purely hydraulic design. An engagement unit 39 of hydraulic design may be advantageously used in the embodiment described with reference to FIGS. 6 and 7.

A hydraulic pump 220 forms a hydraulic pressure source here. This is connected to a first hydraulic line 226 and a second hydraulic line 228 via a directional valve 224 and supplies these lines with hydraulic pressure. The first hydraulic line 226 leads to the hydraulic machine 204, which, in the exemplary embodiment shown here, is firstly connected to a gear system 34. The gear system 34, as described with reference to FIG. 5, is equipped with a hollow shaft through which the driven shaft 32 extends in an axially displaceable manner. As soon as the directional valve 224 switches, hydraulic medium is delivered and the hydraulic machine 204 drives the driven shaft 32.

The engagement unit 39 comprises the second hydraulic line 228 and a hydraulic drive 230, which forms the engagement drive 52. The hydraulic drive 230 is a hydraulic lifting cylinder 232 here, having a cylinder chamber 234 and a piston 236, which is, in turn, connected to the driven shaft 32, preferably with an interconnected axial bearing, and may displace the driven shaft 32 axially. On the side opposite the cylinder chamber 234, a restoring spring 238 is provided, which loads the piston 236 to the left with reference to FIG. 8. The restoring spring 238 serves accordingly to set the engagement to the idle engagement, and the engagement may be set to the working engagement via the pressure in the cylinder chamber 234.

In the second hydraulic line 228, a throttle 240 is provided, which serves to reduce the volume flow somewhat in order to achieve the desired movement speed and therefore gain time for the movement from the idle position into the working position and vice versa.

In this embodiment, the engagement is always automatically set to the working engagement and the idle engagement. As soon as the directional valve 224 switches, hydraulic pressure is supplied to the hydraulic machine 204, which consequently drives the rotor 4, but also to the hydraulic drive 230, which then sets the engagement to the working engagement. If the directional valve 224 is switched such that the hydraulic machine is stationary, the return spring 238 ensures that the engagement is set to the idle engagement.

FIG. 9 shows a similar variant to that in FIG. 8 and identical and similar elements are denoted by the same reference signs. In this regard, please refer to the above description in its entirety.

In contrast to FIG. 8, a hydraulic machine 204, arranged in a fixed manner on the inlet housing 14, is not provided in FIG. 9, but rather the hydraulic machine 204, along the lines of the exemplary embodiment according to FIG. 4, is itself displaceably arranged in the inlet housing 14. The hydraulic drive 230 of the engagement unit 39 acts directly on the hydraulic machine 204 here in order to displace this and thereby set the engagement.

Figure 10:
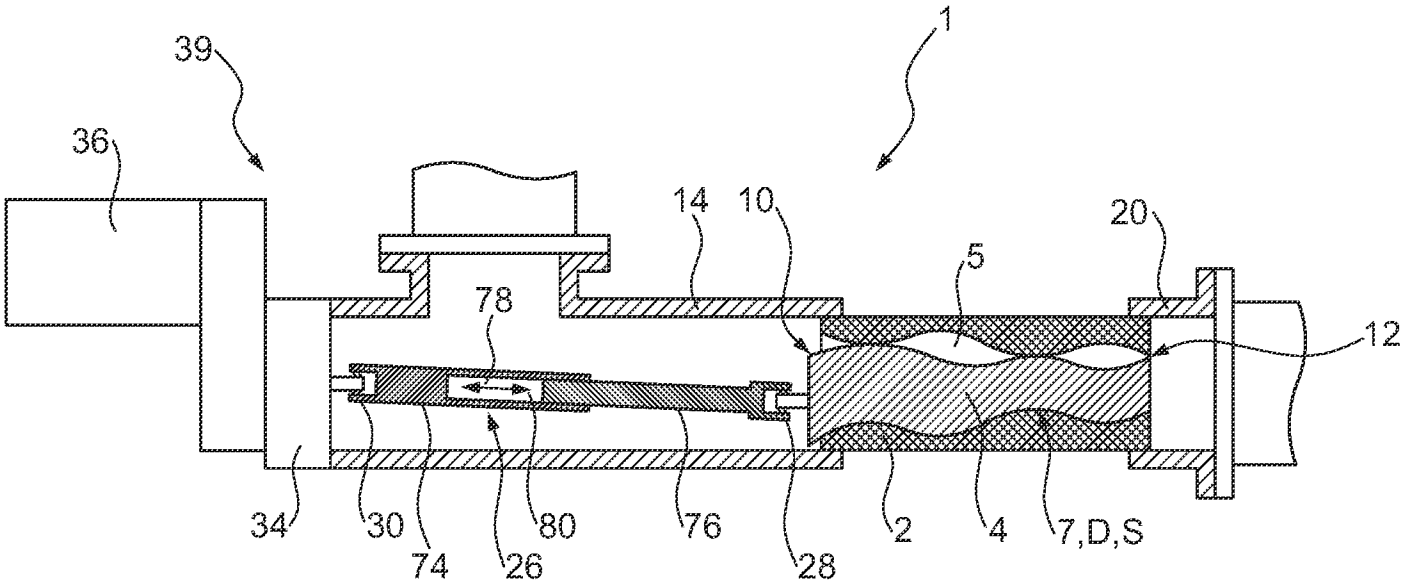
FIG. 10 shows a schematic cross section through an eccentric screw pump according to a seventh exemplary embodiment.

The rotor 4 is also displaceable in the exemplary embodiment according to FIG. 10, whereas the stator 2 is received in a stationary manner in the inlet housing 14 and the outlet housing 20. According to this exemplary embodiment, the drive shaft 26 is designed in two parts and has a first shaft part 74 and a second shaft part 76. The two shaft parts 74, 76 are pushed telescopically one inside the other and an expansion element 80 is formed between the two shaft parts 74, 76, in a recess 78 in the first shaft part 74. The expansion element 80 serves to enable the axial length of the drive shaft 26 to be changed via a displacement of the second shaft part 76 with respect to the first shaft part 74. A displacement of the rotor 4 is enabled via the expansion of the expansion element 80 or a reduction in the expansion element 80. For example, the expansion element 80 may comprise a spindle, a piston, a movable magnetic core, electroactive polymers, or the like, which enable a movement as a result of an actuating procedure. An electrical connection may be realized via the driven shaft 32 or implemented inductively and/or via radio. A sliding contact may also be considered.

Figure 11:
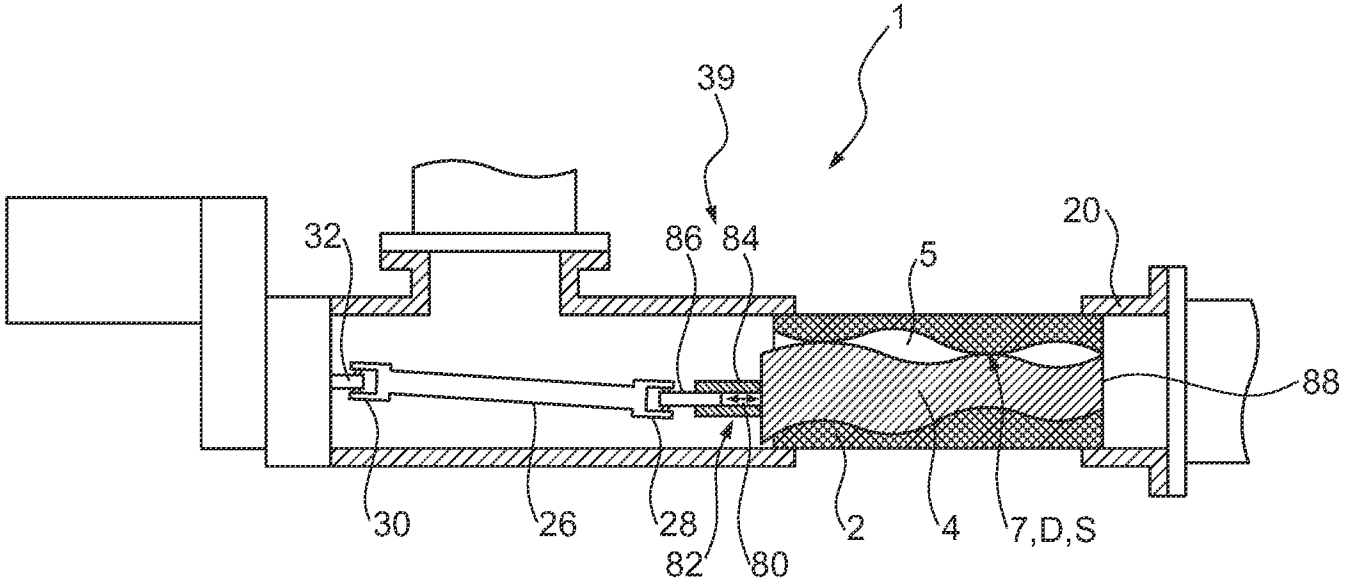
FIG. 11 shows a schematic cross section through an eccentric screw pump according to an eighth exemplary embodiment.

Finally, FIG. 11 shows an exemplary embodiment of the eccentric screw pump 1, which in turn enables a displacement of the rotor 4 with respect to the stator 2. In this exemplary embodiment, the drive shaft 26 is again formed in one part, as in the first four exemplary embodiments of FIGS. 1, 4, 5, and 6. The drive shaft 26 is connected to the driven shaft 32 by means of a Cardan joint 30.

In the exemplary embodiment according to FIG. 11, the shaft journal 82, which connects the Cardan joint 28 to the rotor 4, is formed in two parts and has a first part 84, which is rigidly connected to the rotor 4, and a second part 86, which is connected to the Cardan joint 28. The parts 84 and 86 are pushed telescopically one inside the other and an expansion element 80, corresponding to the expansion element 80 according to FIG. 10, is formed in the part 84. Alternatively, it may also be provided that a drive acts on the end face 88 of the rotor 4, which drive displaces the rotor 4 axially.

Although the electronic control device 58 and the engagement control 53 are only shown by way of example in the exemplary embodiment according to FIG. 4, it should be understood that they may also be present in the other exemplary embodiments. Likewise, each exemplary embodiment may be equipped with a hydraulic engagement unit 39 as shown in FIGS. 8 and 9, even if the drive motor 36 is not designed as a hydraulic machine 204.

Figure 12:
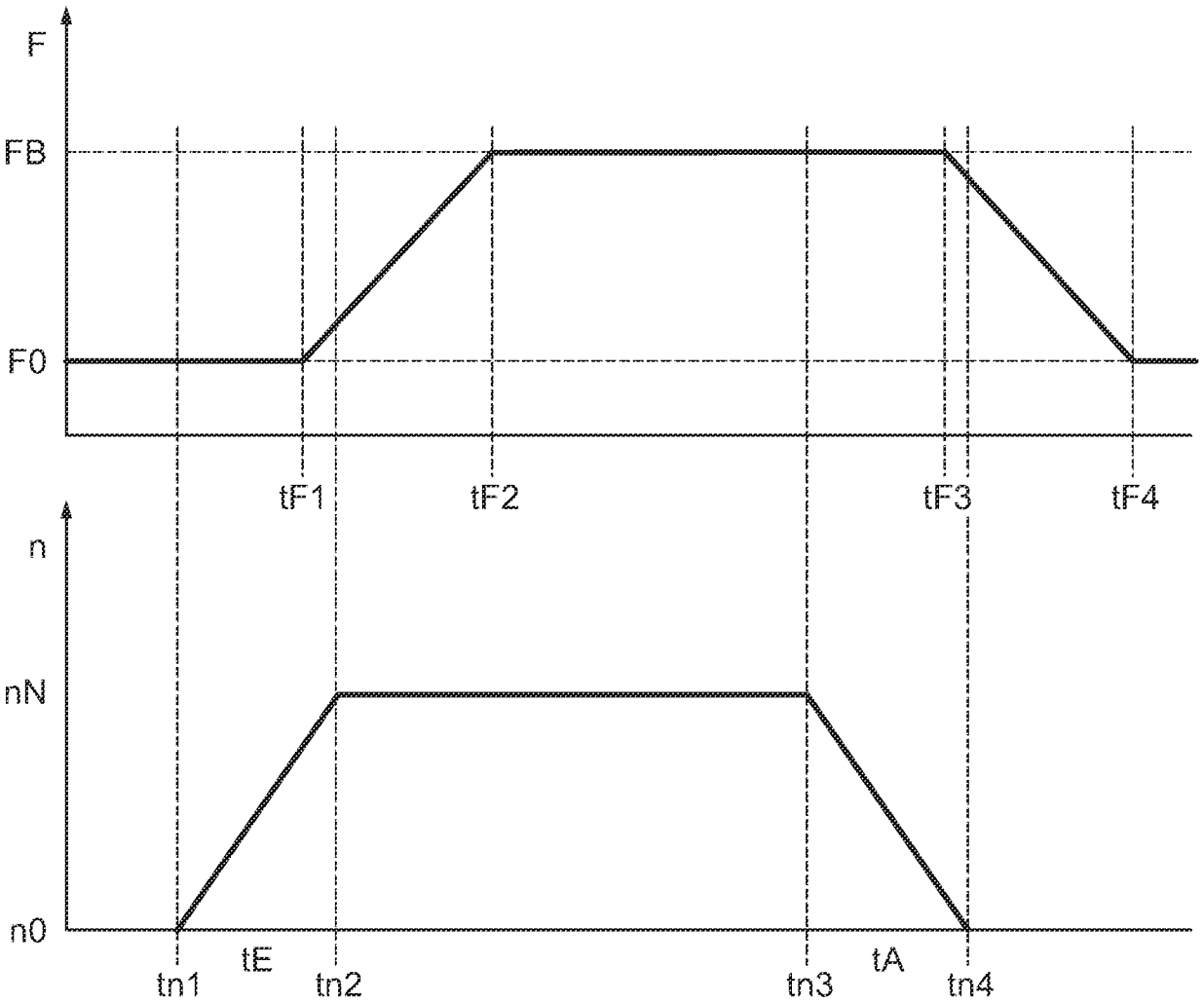
FIG. 12 shows a graph.

The relationship between the working state, the idle state, the working engagement FB and the idle engagement F0 is now described with reference to a graph shown in FIG. 12. The engagement F is plotted against time t in the top graph, the speed n of the rotor 4 is plotted against time tin the bottom graph.

At the start, approximately at the origin of the coordinate systems, the speed n=n0=0 and the engagement F is set to the idle engagement F0. The fact that the value F0 is not on the x-coordinate here shall not necessarily mean that the idle engagement or idle pre-tension is positive; rather, the rotor 4 and stator 2 may not be touching one another, or may be only marginally touching one another, so that the stator 2 is completely or substantially without tension. In any case, the idle engagement or idle pre-tension F0 should be selected such that a relaxation and creep of the material of the stator 2 do not occur at contact points of the stator 2, or a sufficiently large gap is established if the stator is a solid stator.

At a time tn1, a start signal is output, for example via the output interface 200. In response to this, the electronic control device 58 actuates the drive motor 36 and this drives the rotor 4, which begins to rotate. The speed n of the rotor 4 increases to the setpoint speed nN, which is reached at the time tn2. The working state (with respect to the speed) is also reached here. The time period between tn1 and tn2 may be described as the run-in time period, ramp-up time period, or start-up time period. In the exemplary embodiment shown in FIG. 12, the engagement F is increased from the idle engagement F0 to the working engagement FB partly within the run-in time period. This is carried out automatically by the engagement unit 39, likewise in response to the start signal. A time interval is provided between the time tn1 and a time tF1 at which the engagement unit 39 begins to increase the engagement F, for example, via an axial adjustment of the rotor 4. This is not compulsory; it may likewise be provided that the times tn1 and tF1 coincide, or tF1 is before tn1. The latter case is particularly preferred if the rotor 4 lies against the stator 2 and a certain relaxation at the contact points occurs due to the weight force of the rotor 4 on the stator 2. In this case, it is preferred, for example, to firstly displace the rotor 4 a short distance axially before the rotation of the rotor 4 is started. The time tF1 is preferably after the time tn2, preferably offset by a predetermined wait time of, for example, 1, 2, 3, 5 or 10 seconds. It can furthermore be seen from FIG. 12 that the gradient of the engagement is less than the gradient of the speed. This is also not a requirement and these gradients may be adapted and selected according to the type of operation, the pump fluid, the material and the material pairing.

After the eccentric screw pump 1 has been operating with the working engagement FB in the working state from the time tF2, a stop signal is output at the time tn3, for example, in turn via the input interface 200. However, this may also be an automatically generated stop signal, for example, based on the time difference between tn2 and tn3 or based on a sensor signal. From that time, the speed n of the rotor 4 is reduced again by the electronic control device 58 and drops here with the same gradient as that with which it had also increased. This is also not compulsory and the gradients may differ. In particular, it is often preferred if the standstill is reached as quickly as possible. After the speed n has almost reached the value 0 again, the engagement unit 39 reduces the engagement F from the working engagement FB to the idle engagement F0. The idle engagement F0 is then achieved at the time tF4, which is after the time tn4. The time period between tn3 and tn4 may be described as the run-down time period. In the exemplary embodiment shown here, the change in the engagement F from the working engagement FB to the idle engagement F0 is therefore realized partly within the run-down time period. The periods may also overlap entirely; tF3 may coincide with tn3 and tF4 may coincide with tn4. The time tF3 may also be before the time tn3 or after the time tn4. It is also conceivable and preferred if the time tF4 is before or after the time tn3 and/or before or after the time tn4.

A latency may also be provided between tn3 and tF3 if a start signal is received again shortly after the stop signal is output (at tn3). This latency may be specified according to the particular application and may amount to several seconds or minutes.

The invention claimed is:

1. An eccentric screw pump for delivering solid-laden liquids, the eccentric screw pump comprising:

a helically wound rotor;

a stator having an inlet and an outlet and within which the rotor is arranged to be rotatable about a longitudinal axis of the stator, and which has a helical inner wall corresponding to the rotor;

wherein the rotor and stator are arranged with respect to one another such that at least one chamber is formed which serves to transport the liquid, and the chamber is separated by a sealing line;

a drive motor for rotating the rotor;

a control device for controlling the drive motor at least in a working state, in which the rotor is rotated, and an idle state, in which the rotor does not rotate; and an engagement unit adapted to set an engagement between the rotor and stator to an idle engagement in the idle state and to a working engagement in the working state, wherein the idle engagement is less than the working engagement and wherein an engagement reduction from the working engagement to the idle engagement occurs after a predetermined idle time.

2. The eccentric screw pump according to claim 1, wherein the idle engagement is set such that contact between the rotor and stator is substantially free of tension.

3. The eccentric screw pump according to claim 1, wherein, in the working engagement, a substantially complete sealing line is formed between the rotor and stator.

4. The eccentric screw pump according to claim 1, wherein the engagement unit is adapted to adjust the engagement from the working engagement to the idle engagement in or before a run-down time period, wherein the run-down time period comprises a switch from the working state to the idle state.

5. The eccentric screw pump according to claim 1, wherein the engagement unit is adapted to adjust the engagement from the idle engagement to the working engagement in a run-in time period or thereafter, wherein the run-in time period comprises a switch from the idle state to the working state.

6. The eccentric screw pump according to claim 1, wherein the engagement unit comprises an electronic engagement control and an engagement drive actuated by the electronic engagement control to change the engagement.

7. The eccentric screw pump according to claim 1, wherein the engagement unit comprises a hydraulic path and a hydraulic drive which is coupled to the rotor and/or stator such that the engagement is adjusted by applying a hydraulic pressure.

8. The eccentric screw pump according to claim 1, wherein the rotor has a tapering or conical form.

9. The eccentric screw pump according to claim 8, wherein the rotor tapers towards the outlet.

10. The eccentric screw pump according to claim 1, wherein the rotor has a varying eccentricity.

11. The eccentric screw pump according to claim 1, wherein the adjustment of the engagement from the working engagement to the idle engagement comprises an axial displacement of the rotor.

12. The eccentric screw pump according to claim 1, wherein the rotor is axially displaceable between a working position and an idle position.

13. The eccentric screw pump according to claim 1, wherein the stator comprises a supporting element and an elastomer part, and wherein the engagement comprises a pre-tension between the rotor and stator so that the working engagement is a working pre-tension and the idle engagement is an idle pre-tension.

14. The eccentric screw pump according to claim 13, wherein the stator is radially engageable in order to adjust the pre-tension between the working pre-tension and the idle pre-tension.

15. The eccentric screw pump according to claim 13, wherein two adjustment elements are arranged on the stator and have a variable mutual spacing, and wherein a mechanical coupling is established between the adjustment elements and the stator so that, by altering the relative distance between the two adjustment elements, it is possible to change a cross section and a length of an elastomer part of the stator.

16. The eccentric screw pump according to claim 1, wherein the stator is a solid stator and the working engagement is selected such that a sealing line is formed and the idle engagement is selected such that a gap is formed between the rotor and stator.

17. A method for controlling an eccentric screw pump, the method comprising the steps of:

providing an eccentric screw pump comprising:

a helically wound rotor;

a stator having an inlet and an outlet and within which the rotor is arranged to be rotatable about a longitudinal axis of the stator, and which has a helical inner wall corresponding to the rotor, wherein the rotor and stator are arranged with respect to one another such that at least one chamber is formed which serves to transport the liquid, and the chamber is separated by a sealing line;

a drive motor for rotating the rotor;

a control device for controlling the drive motor at least in a working state, in which the rotor is rotated, and an idle state, in which the rotor does not rotate; and an engagement unit adapted to set an engagement between the rotor and stator to an idle engagement in the idle state and to a working engagement in the working state, wherein the idle engagement is less than the working engagement and wherein an engagement reduction from the working engagement to the idle engagement occurs after a predetermined idle time;

operating the eccentric screw pump in the working state by rotating the rotor within the stator of the eccentric screw pump with the working engagement between the rotor and stator;

outputting a stop signal and, in response to the stop signal:

stopping the rotation and switching to the idle state of the eccentric screw pump; and reducing the engagement between the rotor and stator from the working engagement to the idle engagement.

18. The method according to claim 17, wherein a run-down time period is defined by a time from the stop signal being output to a rotational standstill of the rotor, and the reduction in the engagement from the working engagement to the idle engagement takes place substantially at least partly during or following the run-down period.

19. The method according to claim 18, further comprising the steps of:

outputting a start signal; and in response to the start signal, beginning the rotation of the rotor and switching from the idle state to the working state of the eccentric screw pump.

20. The method according to claim 19, further comprising the step of, in response to the start signal:

increasing the engagement between the rotor and stator from the idle engagement to the working engagement in a run-in time period or thereafter.

21. The method according to claim 20, wherein the run-in time period is defined by a time from the start signal being output to a setpoint speed of the rotor being reached, and the increase in the engagement from the idle engagement to the working engagement takes place at least partly during or following the run-in time period.

22. A method according to claim 17, wherein the reduction in the engagement between the rotor and stator from the working engagement to the idle engagement comprises an axial displacement of the rotor from a working position into an idle position.

23. The method according to claim 17, wherein the reduction in the engagement between the rotor and stator from the working engagement to an idle engagement comprises altering a relative distance between two adjustment elements on the stator for changing a cross section and a length of an elastomer part of the stator.

24. The method according to claim 22, wherein the working position and the idle position are spaced apart between 1/50 and 1/4 of a pitch of the rotor.

* * * * *